US008048237B2

(12) United States Patent
Kimura et al.

(10) Patent No.: US 8,048,237 B2
(45) **Date of Patent: *Nov. 1, 2011**

(54) ULTRA SOFT HIGH CARBON HOT ROLLED STEEL SHEET AND METHOD FOR MANUFACTURING SAME

(75) Inventors: Hideyuki Kimura, Tokyo (JP); Takeshi Fujita, Tokyo (JP); Nobuyuki Nakamura, Tokyo (JP); Naoya Aoki, Tokyo (JP); Masato Sasaki, Tokyo (JP); Satoshi Ueoka, Tokyo (JP); Shunji Iizuka, Tokyo (JP)

(73) Assignee: JFE Steel Corporation (JP)

( * ) Notice: Subject to any disclaimer, the term of this patent is extended or adjusted under 35 U.S.C. 154(b) by 387 days.

This patent is subject to a terminal disclaimer.

(21) Appl. No.: 12/294,639

(22) PCT Filed: Feb. 26, 2007

(86) PCT No.: PCT/JP2007/054110

§ 371 (c)(1),
(2), (4) Date: Sep. 26, 2008

(87) PCT Pub. No.: WO2007/111080

PCT Pub. Date: Oct. 4, 2007

(65) Prior Publication Data

US 2010/0282376 A1 Nov. 11, 2010

(30) Foreign Application Priority Data

| | | |
|---|---|---|
| Mar. 28, 2006 | (JP) | 2006-087968 |
| Mar. 28, 2006 | (JP) | 2006-087969 |
| Jan. 26, 2007 | (JP) | 2007-015724 |

(51) Int. Cl.

| | |
|---|---|
| ***C22C 38/00*** | (2006.01) |
| ***C22C 38/22*** | (2006.01) |
| ***C22C 38/18*** | (2006.01) |
| ***C22C 38/12*** | (2006.01) |
| ***C22C 38/14*** | (2006.01) |
| ***C21D 8/02*** | (2006.01) |
| ***C21D 8/00*** | (2006.01) |
| ***C21D 6/00*** | (2006.01) |

(52) U.S. Cl. ..... 148/320; 148/330; 148/333; 148/334; 148/602; 148/654; 148/659; 148/662; 420/104; 420/105; 420/106; 420/110; 420/121; 420/123; 420/128

(58) Field of Classification Search ..... 148/602, 148/320, 330, 333, 334, 654, 659, 662; 420/104–106, 110, 121, 123, 128
See application file for complete search history.

(56) References Cited

U.S. PATENT DOCUMENTS

2005/0199322 A1 9/2005 Nakamura et al.

FOREIGN PATENT DOCUMENTS

| | | | |
|---|---|---|---|
| EP | 1 932 933 | A1 | 6/2008 |
| JP | 9-157758 | A | 6/1997 |
| JP | 11-80885 | A | 3/1999 |
| JP | 11-256272 | A | 9/1999 |
| JP | 11-269552 | A | 10/1999 |
| JP | 11-269553 | A | 10/1999 |
| JP | 2001-220642 | A | 8/2001 |
| JP | 2003-013144 | A | 1/2003 |
| JP | 2003-013145 | A | 1/2003 |
| JP | 2003-73742 | A | 3/2003 |
| JP | 2003-293083 | A | 10/2003 |
| JP | 2005-290547 | A | 10/2005 |
| WO | 2007/043318 | A1 | 4/2007 |

OTHER PUBLICATIONS

Fujita et al., English machine translation of JP 2003-073742, Mar. 2003.*
Fukui et al., English machine translation of JP 2001-220642, Aug. 2001.*

* cited by examiner

*Primary Examiner* — Roy King
*Assistant Examiner* — Caitlin Kiechle
(74) *Attorney, Agent, or Firm* — DLA Piper LLP (US)

(57) ABSTRACT

An ultra soft high carbon hot-rolled steel sheet has excellent workability. The steel sheet is a high carbon hot-rolled steel sheet containing 0.2 to 0.7% C, and has a structure in which mean grain size of ferrite is 20 μm or larger, the volume percentage of ferrite grains having 10 μm or smaller size is 20% or less, mean diameter of carbide is in a range from 0.10 μm to smaller than 2.0 μm, the percentage of carbide grains having 5 or more of aspect ratio is 15% or less, and the contact ratio of carbide is 20% or less.

13 Claims, No Drawings

ULTRA SOFT HIGH CARBON HOT ROLLED STEEL SHEET AND METHOD FOR MANUFACTURING SAME

RELATED APPLICATIONS

This is a §371 of International Application No. PCT/JP2007/054110, with an international filing date of Feb. 26, 2007 (WO 2007/111080, published Oct. 4, 2007), which is based on Japanese Patent Application Nos. 2006-087968, filed Mar. 28, 2006, 2006-087969, filed Mar. 28, 2006, and 2007-015724, filed Jan. 26, 2007.

TECHNICAL FIELD

This disclosure relates to an ultra soft high carbon hot-rolled steel sheet, specifically an ultra soft high carbon hot-rolled steel sheet having excellent workability, and to a method for manufacturing thereof.

BACKGROUND

High carbon steel sheets used for tools, automobile parts (gears and transmissions and the like are subjected to heat treatment such as quenching and tempering after punching and forming. Aiming at cost reduction, manufactures of tools and parts, or the users of high carbon steel sheets, study in recent years the simplification of conventional parts-working by machining and hot forging of cast to shift toward the press forming (including cold-forging) of steel sheets. Responding to the movement, the high carbon steel sheets as the base material are requested to have excellent ductility for forming into complex shapes and to have excellent bore expanding workability (burring property) in the forming step after punching. The bore expanding workability is generally evaluated by the stretch flangeability. Accordingly, there is wanted a material that has both excellent ductility and excellent stretch flangeability. In addition, from the point of reducing load on press machine and mold, the material is also strongly requested to be mild.

In the current state, there are studied several technologies for softening the high carbon steel sheets. For example, Japanese Patent Laid-Open No. 9-157758 proposes a method for manufacturing high carbon steel strip by heating a hot-rolled steel strip into a dual-phase region of ferrite-austenite at a specified heating rate, followed by annealing the steel strip at a specified cooling rate. According to the technology, the high carbon steel strip is annealed in a dual-phase region of ferrite-austenite at Ac1 point or higher temperature, thus obtaining a structure of homogeneously distributing large spheroidized cementite in the ferrite matrix. In detail, a high carbon steel containing 0.2 to 0.8% C, 0.03 to 0.30% Si, 0.20 to 1.50% Mn, 0.01 to 0.10% Sol.Al 0.0020 to 0.0100% N, and 5 to 10 Sol.Al/N is hot-rolled, pickled, and descaled, and then the descaled high carbon steel is annealed in a furnace having an atmosphere of 95% or more by volume of hydrogen and balance of nitrogen at a temperature of 680° C. or above, with a heating rate Tv (° C./hr) from 500×(0.01−N(%) as AN) to 2000×(0.1−N(%) as MN), and a soaking temperature TA(° C.) from Ac1 point to 222×C(%)2−411×C(%)+912, for a soaking time of 1 to 20 hours, followed by cooling the steel to room temperature at a cooling rate of 100° C./hr or less.

For the improvement of stretch flangeability of the high carbon steel sheet, several technologies have been studied. For example, Japanese Patent Laid-Open No. 11-269552 proposes a method for manufacturing medium to high carbon steel sheets having excellent stretch flangeability using a process containing cold rolling. According to the technology, a hot-rolled steel sheet containing 0.1 to 0.8% C by mass, and having the metal structure of substantially ferrite and pearlite, and specifying, at need, the area percentage of ferrite and the gap between pearlite lamellae, is subjected to cold rolling of 15% or more of reduction in thickness, followed by applying three-stage or two-stage annealing.

Japanese Patent Laid-Open No. 11-269553 discloses a technology of annealing a hot-rolled steel sheet containing 0.1 to 0.8% C by mass, and having a ferrite and pearlite structure with the area percentage of ferrite (%) of at or higher than a certain value determined by the C content, while applying heating and holding in the first stage and those in the second stage continuously.

Above-disclosed technologies, however, have the following-described problems.

The technology described in Japanese Patent Laid-Open No. 9-157758 anneals a high carbon steel strip in a dual phase region of ferrite-austenite at Ac1 point or higher temperature, thus forming large spheroidized cementite. It is, however, known that the coarse cementite acts as the origin of void during working step and deteriorates the hardenability owing to the slow dissolution rate of the coarse cementite. Furthermore, for the hardness after annealing, an S35C material gives Hv of 132 to 141 (HRB of 72 to 75), which cannot be said "the mild steel."

The technologies described in Japanese Patent Laid-Open Nos. 11-269552 and 11-269553 have the ferrite structure formed by ferrite, and the ferrite contains substantially no carbide, thus the material is mild and gives high ductility. However, the stretch flangeability thereof is not necessarily favorable because the punching induces deformation at the ferrite portion in the vicinity of punched edge face so that the deformation considerably differs between the ferrite and the ferrite containing spheroidized carbide. As a result, stress intensifies in the vicinity of boundary of grains giving considerably large difference in the deformation, which results in generation of void. The void grows to crack, thus presumably deteriorating the stretch flangeability.

A countermeasure to the problem is to strengthen the spheroidizing annealing to soften the entire material. In that case, however, the spheroidized carbide becomes coarse to become the origin of void, and the carbide hardly dissolves in the heat treatment step after working, which decreases the quench strength.

Furthermore, the requirements of working level have become severer than ever from the point of productivity improvement. Accordingly, also the bore expanding working of high carbon steel sheet has become likely induced cracks on the punched edge face owing to the increase in the working degrees and other working variables. Therefore, the high carbon steel sheets are also requested to have high stretch flangeability.

Responding to those situations, we developed the technology described in Japanese Patent Laid-Open No. 2003-13145 to provide a high carbon steel sheet which hardly induces cracks on the punched edge face and which has excellent stretch flangeability. Owing to the technology, the manufacture of high carbon hot-rolled steel sheets having excellent stretch flangeability has become available.

Japanese Patent Laid-Open No. 2003-13145 is a technology of hot-rolling a steel containing 0.2 to 0.7% C by mass at a finishing temperature of (Ar3 transformation point −20° C.) or above, and cooling the hot-rolled steel sheet to a cooling-stop temperature of 650° C. or below at a cooling rate of higher than 120° C./sec, then coiling the cooled steel sheet at 600° C. or lower temperature, followed by pickling, and finally annealing the pickled steel sheet at a temperature ranging from 640° C. to Ad transformation point. As for the metal structure, the technology controls a mean diameter of carbide to a range from 0.1 μm to smaller than 1.2 μm, and the volume percentage of ferrite grains not containing carbide to 10% or less.

To reduce the manufacturing cost of driving-system parts, integral molding method using a press machine has recently been brought into practical applications. With the movement, the steel sheets as the base material are subjected to forming with combinations of complex forming modes of not only burring but also stretching, bending, and the like, thus the steel sheets are requested to have both the excellent stretch flangeability and the excellent ductility. In this regard, the technology of Japanese Patent Laid-Open No. 2003-13145 does not describe the ductility.

It could therefore be helpful to provide an ultra soft high carbon hot-rolled steel sheet which can be manufactured without applying time-consuming multi-stage annealing, which generates very few cracks on a punched edge face, and which generates very few cracks caused by press molding and cold forging, or having excellent workability giving 70% or larger hole expanding ratio λ, and 35% or larger total elongation as an evaluation index of ductility, and to provide a method for manufacturing the ultra soft high carbon hot-rolled steel sheet.

SUMMARY

Our steel sheets and methods resulted from a series of detail studies of the effect of composition, microstructure, and manufacturing conditions on the ductility, the stretch flangeability, and the hardness of high carbon steel sheets. Those studies found that the major variables significantly affecting the hardness of steel sheet are not only the composition and the shape and amount of carbide but also the mean grain size, morphology, and dispersed state of carbide grains, the mean grain size of ferrite, and the volume percentage of fine ferrite grains (volume percentage of ferrite grains having a size not larger than a specified one). Then, we found that the control of mean grain size, morphology, and dispersed state of carbide grains, the mean grain size of ferrite, and the volume percentage of fine ferrite grains to an adequate range, respectively, can significantly decrease the hardness of high carbon steel sheet and also can significantly increase the ductility and the stretch flangeability.

Furthermore, based on the above findings, the manufacturing method for controlling the above structure was studied, and there has been established a method for manufacturing ultra soft high carbon hot-rolled steel sheet having excellent workability.

We thus provide:

[1] An ultra soft high carbon hot rolled steel sheet contains 0.2 to 0.7% C, 0.01 to 1.0% Si, 0.1 to 1.0% Mn, 0.03% or less P, 0.035% or less S, 0.08% or less Al, 0.01% or less N, by mass, and balance of iron and inevitable impurities, wherein mean grain size of ferrite is 20 μm or larger, the volume percentage of ferrite grains having 10 μm or smaller size is 20% or less, mean diameter of carbide is in a range from 0.10 μm to smaller than 2.0 μm, the percentage of carbide grains having 5 or more of aspect ratio is 15% or less, and the contact ratio of carbide is 20% or less.

[2] An ultra soft high carbon hot rolled steel sheet contains 0.2 to 0.7% C, 0.01 to 1.0% Si, 0.1 to 1.0% Mn, 0.03% or less P, 0.035% or less S, 0.08% or less Al, 0.01% or less N, by mass, and balance of iron and inevitable impurities, wherein the mean grain size of ferrite is larger than 35 μm, the volume percentage of ferrite grains having 20 μm or smaller size is 20% or less, the mean diameter of carbide is in a range from 0.10 μm to smaller than 2.0 μm, the percentage of carbide grains having 5 or more of aspect ratio is 15% or less, and the contact ratio of carbide is 20% or less.

[3] The ultra soft high carbon hot-rolled steel sheet according to [1] and [2] further contains one or both of 0.0010 to 0.0050% B and 0.005 to 0.30% Cr, by mass.

[4] The ultra soft high carbon hot-rolled steel sheet according to [1] and [2] further contains 0.0010 to 0.0050% B and 0.05 to 0.30% Cr, by mass.

[5] The ultra soft high carbon hot-rolled steel sheet according to any of [1] to [4] further contains one or more of 0.005 to 0.5% Mo, 0.005 to 0.05% Ti, and 0.005 to 0.1% Nb, by mass.

[6] A method for manufacturing ultra soft high carbon hot-rolled steel sheet has the steps of: rough-rolling a steel having. the composition according to any of [1], [3], [4], and [5]; finish-rolling the rough-rolled steel sheet at a temperature of 1100° C. or below at an inlet of finish rolling, a reduction in thickness of 12% or more at the final pass, and a finishing temperature of (Ar3−10)° C. or above; primary-cooling the finish-rolled steel sheet to a cooling-stop temperature of 600° C. or below within 1.8 seconds after the finish rolling at a cooling rate of higher than 120° C./sec; secondary-cooling the primary-cooled steel sheet to hold the steel sheet at a temperature of 600° C. or below; coiling the secondary-cooled steel sheet at a temperature of 580° C. or below; pickling the coiled steel sheet; and spheroidizing-annealing the pickled steel sheet by a box annealing method at a temperature in a range from 680° C. to Ac1 transformation point.

[7] A method for manufacturing ultra soft high carbon hot-rolled steel sheet has the steps of: rough-rolling a steel having the composition according to any of [2] to [5]; finish-rolling the rough-rolled steel sheet at a temperature of 1100° C. or below at an inlet of finish rolling, at a reduction in thickness of 12% or more at each of the final two passes, and in a temperature range from (Ar3−10)° C. to (Ar3+90)° C.; primary-cooling the finish-rolled steel sheet to a cooling-stop temperature of 600° C. or below within 1.8 seconds after the finish rolling at a cooling rate of higher than 120° C./sec; secondary-cooling the primary-cooled steel sheet to hold the steel sheet at a temperature of 600° C. or below; coiling the secondary-cooled steel sheet at a temperature of 580° C. or below; pickling the coiled steel sheet; and spheroidizing-annealing the pickled steel sheet by a box annealing method at a temperature in a range from 680° C. to Ac1 transformation point, with a soaking time of 20 hours or more.

[8] The method for manufacturing ultra soft high carbon hot-rolled steel sheet according to [7], wherein the finish rolling is conducted at a temperature at 1050° C. or below at the inlet of finish rolling, and the reduction in thickness of 15% or more at each of the final two passes.

The symbol "%" for the component of steel in this description is "% by mass."

This results in a high carbon hot-rolled steel sheet that is very mild and has excellent ductility and stretch flangeability.

Also, we attain equiaxed and uniformly dispersed carbide grains after annealing, and further attain homogeneous and coarse ferrite grains through the control of not only the spheroidizing annealing condition after hot rolling but also the composition of hot-rolled steel sheet before annealing, or the hot rolling condition. That is, the ultra soft high carbon hot-rolled steel sheet can be manufactured without applying high temperature annealing and multi-stage annealing. As a result, there can be manufactured a high carbon hot-rolled steel sheet that is very mild and with excellent ductility and stretch flangeability, thus achieving simplification of working process and cost reduction.

DETAILED DESCRIPTION

The ultra soft high carbon hot-rolled steel sheet has a controlled composition and components given below, and has a structure of: 20 μm or larger mean grain size of ferrite; 20% or less of volume percentage of ferrite grains having 10 μm or smaller size, (hereinafter referred to as the "volume percentage of fine ferrite grains (10 μm or smaller size)"); mean diameter of carbide in a range from 0.10 μm to smaller than 2.0 μm; 15% or less of percentage of carbide grains having 5 or more of aspect ratio; and 20% or less of contact ratio of carbide. A preferable structure is: larger than 35 μm of mean grain size of ferrite; 20% or less of volume-percentage of ferrite grains having 20 μm or smaller size, (hereinafter referred to as the "volume percentage of fine ferrite grains (20 μm or smaller size)"); mean diameter of carbide in a range from 0.10 μm to smaller than 2.0 μm; 15% or less of percentage of carbide grains having 5 or more of aspect ratio; and 20% or less of contact ratio of carbide. Those values are the most important conditions in the present invention. With that specification and satisfaction of the composition and components, the metal stricture (mean grain size of ferrite and volume percentage of fine ferrite grains), the shape (mean grain size), morphology, and dispersed state of carbide grains, there is obtained the high carbon hot-rolled steel sheet in very mild and with excellent workability.

The above-described ultra soft high carbon hot-rolled steel sheet can be manufactured by the steps of: rough-rolling a steel having the composition described later; hot-rolling the rough-rolled steel sheet at a temperature of 1100° C. or below at inlet of finish rolling, a reduction in thickness of 12% or more at the final pass in the finish-rolling mill, and a finishing temperature of (Ar3−10)° C. or above; primary-cooling the finish-rolled steel sheet to a cooling-stop temperature of 600° C. or below within 1.8 seconds after the finish rolling at a cooling rate of higher than 120° C./sec; secondary-cooling the primary-cooled steel sheet to hold the steel sheet at a temperature of 600° C. or below; coiling the secondary-cooled steel sheet at a temperature of 580° C. or below; pickling the coiled steel sheet; and spheroidizing-annealing the pickled steel sheet by the box annealing method at a temperature in a range from 680° C. to Ac1 transformation point.

Furthermore, the ultra soft high carbon hot-rolled steel sheet having above preferable structure can be manufactured by the steps of: rough-rolling a steel having the composition described below; finish-rolling the rough-rolled steel sheet at a temperature of 1100° C. or below at inlet of finish rolling, at a reduction in thickness of 12% or more at each of the final two passes in the finish-rolling mill, and in a temperature range from (Ar3−10)° C. to (Ar3+90)° C.; primary-cooling the finish-rolled steel sheet to a cooling-stop temperature of 600° C. or below within 1.8 seconds after the finish rolling at a cooling rate of higher than 120° C./sec; secondary-cooling the primary-cooled steel sheet to hold the steel sheet at a temperature of 600° C. or below; coiling the secondary-cooled steel sheet at a temperature of 580° C. or below; pickling the coiled steel sheet; and spheroidizing-annealing the pickled steel sheet by the box annealing method at a temperature in a range from 680° C. to Ac1 transformation point, with a soaking time of 20 hours or more. More preferably, the finish rolling is given at a temperature of 1050° C. or below at inlet of finish rolling, at a reduction in thickness of 15% or more at each of the final two passes in the finish-rolling mill, and in a temperature range from (Ar3−10)° C. to (Ar3+90)° C., followed by the cooling and spheroidizing annealing as described above. With the total control of the conditions of from hot-finish rolling, primary cooling, secondary cooling, coiling, to annealing, good results are achieved.

The steels are described in detail in the following.

The description begins with the reasons to select the chemical compositions of steel.

(1) C: 0.2 to 0.7%

Carbon is the most basic alloying element in carbon steel. The hardness after quenching and the amount of carbide in annealed state considerably vary with the C content For a steel containing less than 0.2% C, the structure after hot rolling shows significant formation of ferrite, and fails to attain stable coarse ferrite grain structure after annealing, which induces a duplex grain structure to fail to establish stable softening in addition, sufficient quench hardness cannot be attained for applying to automobile parts and the like. If the C content exceeds 0.7%, the volume percentage of carbide becomes large, which increases the contacts between carbide grains, thus considerably deteriorating the ductility and the stretch flangeability. In addition, the toughness after hot rolling decreases to deteriorate the manufacturing and handling easiness of steel strip. Therefore, from the point of providing a steel sheet having the hardness, the ductility, and the stretch flangeability after quenching, the C content is specified to a range from 0.2 to 0.7%.

(2) Si: 0.01 to 1.0%

Silicon is an element to improve the hardenability. If the Si content is less than 0.01%, the hardness after quenching becomes insufficient. If the Si content exceeds 1.0%, the solid solution strengthening occurs to harden the ferrite, and the ductility becomes insufficient. Furthermore, the carbide becomes graphite to likely deteriorate the hardenability. Accordingly, from the point to provide a steel sheet having both the hardness and the ductility after quenching, the Si content is specified to a range from 0.01 to 1.0%, preferably from 0.1 to 0.8%.

(3) Mn: 0.1 to 1.0%

Similar to Si, Mn is an element to improve the hardenability. Also Mn is an important element of fixing S as MnS to prevent the hot tearing of slab. If the Mn content is less than 0.1%, the effect cannot fully be attained, and the hardenability significantly deteriorates. If the Mn content exceeds 1.0%, the solid solution strengthening occurs, which hardens the ferrite to deteriorate the ductility. Consequently, from the point of providing a steel sheet having both the hardness and the ductility after quenching, the Mn content is specified to a range from 0.1 to 1.0%; preferably from 0.3 to 0.8%.

(4) P: 0.03% or Less

Phosphorus is segregated into grain boundary to deteriorate the ductility and the toughness. Therefore, the P content is specified to 0.03% or less, preferably 0.02% or less.

(5) S: 0.035% or Less

Sulfur forms MnS with Mn to deteriorate the ductility, the stretch flangeability, and the toughness after quenching so that S is an element to be decreased in amount, and smaller thereof is better. Since, however, up to 0.035% of S content is allowable, the S content is specified to 0.035% or less, preferably 0.010% or less.

(6) Al: 0.08% or Less

Excess addition of Al results in precipitation of large quantity of AlN, which deteriorates the hardenability. Accordingly, the Al content is specified to 0.08% or less, preferably 0.06% or less.

(7) N: 0.01% or Less

Excess N content induces deterioration of ductility so that the N content is specified to (0.01% or less.

Although the objective characteristics of the steel are obtained by the above essential elements, the steel may further contain one or both of B and Cr. A preferable content range of these additional elements is in the following. Although any of B and Cr may be added, addition of both of them is more preferable.

(8) B: 0.0010 to 0.0050%

Boron is an important element to suppress the formation of ferrite during cooling the steel after hot rolling, and to form uniform coarse ferrite gains after annealing. If, however, the B content is less than 0.0010%, sufficient effect may not be attained. If the B content exceeds 0.0050%, the effect saturates, and the load to hot rolling increases to deteriorate the operability in some cases. Therefore, the B content is, if added, specified to a range from 0.0010 to 0.0050%.

(9) Cr: 0.005 to 0.30%

Chromium is an important element to suppress the formation of ferrite during cooling the steel after hot rolling, and to form uniform coarse ferrite grains after annealing. If, however, the Cr content is less than 0.005%, sufficient effect may not be attained. If the Cr content exceeds 0.30%, the effect of suppressing the ferrite formation saturates, and the cost increases. Therefore, the Cr content is, if added, specified to a range from 0.005 to 0.30%, preferably from 0.05% to 0.30%.

To further suppress the ferrite formation during hot rolling and cooling, thus to improve the hardenability, one or more of Mo, Ti, and Nb may be added at need. In that case, if the added amount is less than 0.005% Mo, less than 0.005% Ti, and less than 0.005% Nb, the added effect may not fully be attained. If the Mo content exceeds 0.5%, the Ti content exceeds 0.05%, and the Nb content exceeds 0.1%, then the effect saturates, and cost increases, further the increase in strength becomes significant owing to the solid solution strengthening, the precipitation strengthening, and the like, thus deteriorating the ductility in some cases. Accordingly, when one or more of Mo, Ti, and Nb are added, the Mo content is specified to a range from 0.005 to 0.5%, the Ti content is specified to a range from 0.005 to 0.05%, and the Nb content is specified to a range from 0.005 to 0.1%.

The remainder of above components is Fe and inevitable impurities. As the inevitable impurities, oxygen, for example, is preferably decreased to: 0.003% or less because O forms a non-metallic inclusion to inversely affect the steel quality. According to the present invention, theThe elements of Cu, Ni, W, Zr, Sn, and Sb may exist in a range of 0.1% or less as the trace elements which do not inversely affect the working effect.

The following is the description about the structure of ultra soft high carbon hot-rolled steel sheet having excellent workability.

(1) Mean Grain Size of Ferrite: 20 μm or Larger

The mean grain size of ferrite is an important variable to control the ductility and the hardness. By bringing the ferrite grains coarse, the steel becomes mild and increases the ductility with the reduction in strength. In addition, by bringing the mean grain size of ferrite larger than 35 μm, the steel becomes more mild and the ductility increases more, thus attaining further excellent workability. Therefore, the mean grain size of ferrite is specified to 20 μm or larger, preferably larger than 35 μm, and more preferably 50 μm or larger.

(2) Volume Percentage of Fine Ferrite Grains (Volume Percentage of Ferrite Grains having 10 μm or Smaller Size or 20 μm or Smaller Size): 20% or Less Coarser ferrite grains bring steel further mild. To stabilize the softening, it is wanted to decrease the percentage of fine ferrite grains having a specified size or smaller. To do this, the volume percentage of ferrite grains having 10 μm or smaller size or 20 μm or smaller size is defined as the volume percentage of fine ferrite grains, and specifies the volume percentage of fine ferrite grains to 20% or less.

If the volume percentage of fine ferrite grains exceeds 20%, a duplex grain structure is formed, which fails to attain stable softening. Therefore, to attain stable and excellent ductility and softening, the volume percentage of fine ferrite grains is specified to 20% or less, preferably 15% or less.

The volume percentage of fine ferrite grains can be determined by deriving the area ratio of the fine ferrite grains having a specified size or smaller to the ferrite grains having larger size than the specified one by observation of metal structure on a cross section of the steel sheet, (10 visual fields or more at about ×200 magnification), and the derived ratio is adopted as the volume percentage.

The steel sheet having coarse ferrite grains and 20% or less of volume percentage of fine ferrite grains can be obtained by controlling the reduction in thickness and the temperature during finish rolling, as described later. In concrete terms, a steel sheet having 20 μm or larger mean grain size of ferrite and 20% or less of volume percentage of fine ferrite grains (10 μm or smaller size) can be obtained by, as described later, conducting finish rolling at a reduction in thickness of 12% or more at the final pass in the finish-rolling mill, and at a finishing temperature of (Ar3−10)° C. or above. By adopting the reduction in thickness of 12% or more in the final pass in the finish-rolling mill, the driving force of grain growth increases, and the ferrite grains uniformly become coarse. The steel sheet having larger than 35 μm of mean grain size of ferrite and having 20% or less of volume percentage of fine ferrite grains (20 μm or smaller size) can be attained by, as described later, conducting finish rolling at a reduction in thickness of 12% or more at each of the final two passes in the finish-rolling mill, and in a temperature range from (Ar3−10)° C. to (Ar3+90)° C. By adopting 12% or more of the reduction in thickness in the final two passes, many shear bands are introduced in the prior-austenite grains, thus increases the number of nuclei-formation sites for transformation. As a result, the lath-shaped ferrite grains structuring the bainite become fine, and the ferrite grains uniformly grow coarse by the driving force of very high grain-boundary energy. Furthermore, by adopting 15% or more of the reduction in thickness for each of the final two passes, the ferrite grains become uniformly coarse.

(3) Mean Grain Size of Carbide: 0.10 μm or Larger and Smaller than 2.0 μm

The mean diameter of carbide is an important variable because it significantly affects the general workability, the punching workability, and the quench strength in the heat treatment step after working. If the carbide grains become fine, the carbide is easily dissolved in the heat treatment step after working, thus allowing assuring the stable quench hardness. If, however, the mean diameter of carbide is smaller than 0.10 μm, the ductility decreases with the increase in the hardness, and the stretch flangeability also deteriorates. On the other hand, the workability improves with the increase in the mean diameter of carbide. If, however, the mean diameter of carbide becomes 2.0 μm or larger, the stretch flangeability deteriorates owing to the generation of void during bore expanding. Therefore, the mean diameter of carbide is specified to a range from 0.10 μm to smaller than 2.0 μm. As described later, the mean diameter of carbide can be controlled by the manufacturing conditions, specifically the primary cooling-stop temperature after hot rolling, the secondary cooling holding temperature, the coiling temperature, and the annealing condition.

(4) Morphology of Carbide: 15% or Less of Percentage of Carbide Grains having 5 or More of Aspect Ratio The morphology of carbide considerably affects the ductility and the stretch flangeability. When the morphology of carbide, or the aspect ratio, becomes 5 or more, a small working generates void, which void develops to crack in the initial stage of working, thus deteriorating the ductility and the stretch flangeability. If, however, the percentage of the carbide grains having 5 or more of aspect ratio is 15% or less, the effect is small. Accordingly, the percentage of carbide grains having 5 or more of aspect ratio is controlled to 15% or less, preferably ably to 10% or less, and more preferably to 5% or less. The aspect ratio of carbide grains can be controlled by the manufacturing conditions, specifically by the temperature at inlet of finish rolling. The aspect ratio of carbide grains is defined as the ratio of major side length to miner side length thereof.

(5) Dispersed State of Carbide Grains: 20% or Less of Contact Ratio of Carbide

Also the dispersed state of carbide grains significantly affects the ductility and the stretch flangeability. When the carbide grains contact with each other, the contact point has already formed void, or forms void with a small working, which void grows to crack in the initial stage of working, thus deteriorating the ductility and the stretch flangeability. If, however, the percentage is 20% or less, the effect is small. Accordingly, the contact ratio of carbide is controlled to 20% or less, preferably to 15% or less, and more preferably 10% or less. The dispersed state of carbide grains can be controlled by the manufacturing conditions, specifically by the cooling-start time after finish rolling. The contact ratio of carbide is the percentage of carbide grains contacting each other to the total number of carbide grains.

The following is the description about the method for manufacturing the ultra soft high carbon hot-rolled steel sheet having excellent workability.

The ultra soft high carbon hot-rolled steel sheet can be manufactured by rough rolling the steel which is adjusted to above chemical component ranges, by finish-rolling the rough-rolled steel sheet under a specified condition, by cooling under a specified cooling condition, by coiling and pickling the cooled steel sheet, then by spheroidizing-annealing the pickled steel sheet using the box annealing method. The following is detail description of the above steps.

(1) Temperature at Inlet of Finish Rolling

By selecting the temperature at inlet of finish rolling to 1100° C. or below, the prior-austenite grains become fine, the bainite lath after finish rolling becomes fine, the aspect ratio of the carbide grains in the lath becomes small, and the percentage of carbide grains having 5 or more of aspect ratio becomes 15% or less after annealing. As a result, the void formation during working is suppressed, and excellent ductility and stretch flangeability are attained. If, however, the temperature at inlet of finish rolling exceeds 1100° C., no satisfactory result is attained. Therefore, the temperature at inlet of finish rolling is specified to 1100° C. or below, and from the point of reduction in aspect ratio of carbide grains, 1050° C. or below is preferred, and 1000° C. or below is more preferable.

(2) Reduction in Thickness and Finishing Temperature (Rolling Temperature) of Finish Rolling By selecting the reduction in thickness of the final pass to 12% or more, many shear bands are introduced in the prior-austenite grains, thus increases the number of nuclei-formation sites for transformation. As a result, the lath-shaped ferrite grains structuring the bainite become fine, and there is obtained a uniform and coarse ferrite grain structure having 20 μm or larger mean grain size of ferrite and 20% or less of volume percentage of fine ferrite grains (10 μm or smaller size) by the driving force of high grain-boundary energy during spheroidizing annealing. If the reduction in thickness of final pass is less than 12%, the lath-shape ferrite grains become coarse so that the driving force for the grain growth becomes insufficient, thus failing in obtaining the ferrite grain structure having 20 μm or larger mean grain size of ferrite and 20% or less of volume percentage of fine ferrite grains (10 μm or smaller size) after annealing, and failing in attaining stable softening. From the above reasons, the reduction in thickness of the final pass is specified to 12% or more, and, from the point of uniform formation of coarse grains, preferably 15% or more, and more preferably 18% or more. If the reduction in thickness of the final pass is 40% or more, the rolling load increases. Therefore, the upper limit of the reduction in thickness of the final pass is preferably specified to less than 40%.

If the finishing temperature of hot rolling of steel. (rolling temperature of the final pass), is below (Ar3−10)° C., the ferrite transformation proceeds in a part to increase the number of ferrite grains so that the duplex grain ferrite structure appears after spheroidizing annealing, thus failing to obtain a ferrite grain structure with 20 μm or larger mean grain size of ferrite and 20% or less of volume percentage of fine ferrite grains (10 μm or smaller size), thereby failing to attain stable softening. Accordingly, the finishing temperature is specified to (Ar3−10)° C. or above. Although the upper limit of the finishing temperature is not specifically limited, high temperatures above 1000° C. likely induce scale-type defects. Therefore, the finishing temperature is preferably 1000° C. or below.

From the above-discussion, the reduction in thickness of the final pass is specified to 12% or more, and the finishing temperature is specified to (Ar3−10)° C. or above.

Furthermore, adding to the reduction in thickness of the final pass, when the reduction in thickness of the pass before the final pass is specified to 12% or more, the cumulative effect of strain generates many shear bands in the prior-austenite grains, thereby increasing the number of nuclei-formation sites for transformation. As a result, the lath-shape ferrite grains structuring the bainite become fine, and the high grain boundary energy is utilized as the driving force during spheroidizing annealing to obtain a uniform and coarse ferrite grain structure having larger than 35 μm of mean grain size of ferrite and 20% or less of volume percentage of fine ferrite grains (20 μm or smaller size). If the reduction in thickness of the final pass and of the pass before the final pass, (hereinafter the sum of the final pass and the pass before the final pass is referred to as the "final two passes"), is less than 12%, respectively, the lath-shape ferrite grains become coarse, which leads to insufficient driving force for grain growth, and fails to obtain a ferrite grain structure having larger than 35 μn of mean grain size of ferrite and having 20% or less of volume percentage of fine ferrite grains (20 μm or smaller size) after annealing, and fails to attain stable softening. From the above reasons, the reduction in thickness of the final two passes is preferably specified to 12% or more, respectively, and for attaining more uniform coarse grains, the reduction in thickness of the final two passes is more preferably specified to 15% or more, respectively. If the reduction in thickness of the final two passes is 40% or more, respectively, the rolling load increases so that the upper limit of the reduction in thickness of the final two passes is preferably specified to less than 40%, respectively.

When the finishing temperature of the final two passes is in a range from (Ar3−10)° C. to (Ar3+90)° C., the cumulative effect of strain becomes maximum, thus attaining a uniform and coarse ferrite grain structure having larger than 35 μm of mean grain size of ferrite and having 20% or less of volume percentage of fine ferrite grains (20 μm or smaller size) during spheroidizing annealing. If the rolling temperature in the finish final two passes is below (Ar3−20)° C., the ferrite transformation proceeds in a part to increase the number of ferrite grains so that the duplex grain ferrite structure appears after spheroidizing annealing, thus failing to obtain a ferrite grain structure with larger than 35 μm of mean grain size of ferrite and 20% or less of volume percentage of fine ferrite grains (20 μm or smaller size) after annealing, thereby failing to attain further stable softening. If the rolling temperature in the finish final two passes exceeds (Ar3+90)° C., the strain recovery results in insufficient cumulative effect of strain, thus failing to obtain the ferrite grain structure having larger than 35 μm of mean grain size of ferrite and having 20% or less of volume percentage of fine ferrite grains (20 μm or smaller size) after annealing, thereby failing to attain further stable softening, in some cases. From the above reasons, the temperature range of rolling in the finish final two passes is preferably specified to a range from (Ar3−10)° C. to (Ar3+90)° C.

Therefore, in the finish rolling, the reduction in thickness of the final two passes is preferably specified to 12% or more, respectively, more preferably in a range from 15% to less than 40%, and the temperature range is preferably specified to a range from (Ar3−10)° C. to (Ar3+90)° C.

The Ar3 transformation point (° C.) can be determined by observation. However, it may be derived by the calculation of equation (1):

$$Ar3=910-310C-80Mn-15Cr-80Mo \quad (1).$$

The element symbol in equation (1) signifies the content of the element (% by mass).

(3) Primary Cooling: Cooling Rate of Higher than 120° C./sec within 1.8 Seconds after Finish Rolling If the primary cooling after hot rolling is slow cooling, the subcooling degree of austenite is small to form a large quantity of ferrite. If the cooling rate is 120° C./sec or less, the ferrite formation becomes significant, and the carbide grains disperse non-uniformly after annealing, thus failing to obtain stable and coarse ferrite grain structure, and softening cannot be attained. Accordingly, the cooling rate of the primary cooling after hot rolling is specified to higher than 120° C./sec, preferably 200° C./sec or more, and more preferably 300° C./sec or more. Although the upper limit of the cooling rate is not specifically defined, when, for example, a sheet of 3.0 mm in thickness is treated, the existing facility capacity has an upper limit of 700° C./sec. If the time between the finish rolling and the cooling start is longer than 1.8 seconds, the distribution of carbide grains becomes non-homogeneous, and the percentage of contacting the carbide grains each other increases. A presumable cause of the phenomenon of contact between carbide grains is that the worked austenite grains recover in a part to make the carbide of bainite non-uniform, which results in the contact between carbide grains. Consequently, the time between the finish rolling and the cooling start is specified to 1.8 seconds or less. To further homogenize the dispersed state of carbide grains, the time between the finish rolling and the cooling start is preferably within 1.5 seconds, and more preferably within 1.0 second.

(4) Primary Cooling-Stop Temperature: 600° C. or Below

If the primary cooling-stop temperature after hot-rolling exceeds 600° C., a large quantity of ferrite is formed. As a result, the carbide grains dispersed non-uniformly after annealing to fail in obtaining the stable and coarse ferrite grain structure, and fail in attaining softening. Accordingly, to stably obtain the bainite structure after hot rolling, the primary cooling-stop temperature after hot rolling is specified to 600° C. or below, preferably 580° C. or below, and more preferably 550° C. or below. Although the lower limit is not defined, it is preferable to specify the lower limit to 300° C. or above because lower temperature more deteriorates the sheet shape.

(5) Secondary Cooling-Stop Temperature: 600° C. or Below

For the case of high carbon steel sheet, the steel sheet temperature may increase after the primary cooling caused by the ferrite transformation, pearlite transformation, and bainite transformation. Therefore, even if the primary cooling-stop temperature is 600° C. or below, when the temperature increases during the period of from the end of primary cooling to the coiling, the ferrite forms. As a result, the carbide grains disperse non-uniformly after annealing, which fails to obtain the stable and coarse ferrite grain structure, and fails to attain softening. Accordingly, it is important for the secondary cooling to control the temperature in the course of from the end of primary cooling to the coiling. Thus, the secondary cooling holds the temperature from the end of primary cooling to the coiling at 600° C. or below, preferably 580° C. or below, and more preferably 550° C. or below. The secondary cooling in this case may be done by laminar cooling and the like.

(6) Coiling Temperature: 580° C. or Below

If the coiling after cooling is done at above 580° C., the lath-shape ferrite grains structuring the bainite become somewhat coarse, and the driving force for grain growth during annealing becomes insufficient, thus failing in obtaining the stable and coarse ferrite grain structure, and failing in attaining softening. If the coiling after cooling is done at 580° C. or below, the lath-shape ferrite grains become fine, and the stable and coarse ferrite grain structure is obtained using high grain boundary energy as the driving force during annealing. Accordingly, the coiling temperature is specified to 580° C. or below, preferably 550° C. or below, and more preferably 530° C. or below. Although the lower limit of the coiling temperature is not specifically defined, lower temperature more deteriorates the sheet shape so that the lower limit of the coiling temperature is preferably specified to 200° C.

(7) Pickling: Performed

The hot-rolled steel sheet after coiling is subjected to pickling to remove scale before spheroidizing annealing. The pickling may be given in accordance with a known method.

(8) Spheroidizing Annealing: Box Annealing at a Temperature Between 680° C. and Ac1 Transformation Point After applying pickling to the hot-rolled steel sheet, annealing is given for the ferrite grains to become sufficient coarse ones and for the carbide to spheroidize. The spheroidizing annealing is largely classified to (1) a method of heating to slightly above Ac1 point, followed by slow cooling, (2) a method of holding a slightly lower temperature from Ac1 point for a long time, and (3) a method of repeating heating and cooling at slightly higher temperature and slightly lower temperature than the Ac1 point. As of these, we adopt the method (2) aiming at both the growth of ferrite grains and the spheroidization of carbide. To do this, the box annealing is adopted because the spheroidizing annealing takes a long time. If the annealing temperature is below 680°

C., both the growth of ferrite grains to coarse ones and the spheroidization of carbide become insufficient, and softening is not fully attained, and further the ductility and the stretch flangeability deteriorate. If the annealing temperature exceeds the Ac1 transformation point, austenitization occurs in a part, and again pearlite is formed during cooling, which also deteriorates the ductility and the stretch flangeability. Therefore, the annealing temperature of spheroidizing annealing is specified to a range from 680° C. to Ac1 transformation point. To stably obtain the ferrite grain structure having larger than 35 μm of mean grain size and having 20% or less of volume percentage of fine ferrite grains (20 μm or smaller size), the time of annealing (soaking) is preferably specified to 20 hours or more, and 40 hours or more is further preferable. The Ac1 transformation point (° C.) can be determined by observation. However, it may be derived by the calculation of equation (2):

$$Ac1=754.83-32.25C+23.32Si-17.76Mn+17.13Cr+4.51\,Mo \quad (2).$$

The element symbol in equation (2) signifies the content of the element (% by mass).

The above procedure provides an ultra soft high carbon hot-rolled steel sheet having excellent workability. The adjustment of components in the high carbon steel can use any of converter and electric furnace. The high carbon steel with thus adjusted components is treated by ingoting—blooming or by continuous casting to form a steel slab as the base steel material. Hot rolling is applied to the steel slab. The slab-heating temperature in the hot rolling is preferably 1300° C. or below to avoid deterioration of surface condition caused by scale formation. Alternatively, hot direct rolling may be applied to as continuously-cast slab or while holding the temperature to suppress the cooling of the slab. Furthermore, there may be applied finish rolling eliminating the rough rolling during the hot rolling. To assure the finishing temperature, the rolling material may be heated by a heating means such as bar heater during the hot rolling. In addition, to enhance the spheroidization or to decrease the hardness, temperature-holding of coil may be applied using a means of slow-cooling cover or the like.

After annealing, skin pass rolling is applied at need. The skin pass rolling is not specifically limited in the condition because the skin pass rolling does not affect the hardness, the ductility, and the stretch flangeability.

The reason that thus obtained high carbon hot-rolled steel sheet is very mild adding to excellent ductility and stretch flangeability is presumably the following. The hardness is strongly affected by the mean grain size of ferrite. When the grain size of ferrite is uniform and coarse, the steel becomes very mild. The ductility and the stretch flangeability improve when the distribution of grain size of ferrite is uniform and the finite grains are coarse, and when the carbide grains are equiaxed and uniformly distributed. Consequently, a high carbon hot-rolled steel sheet in very mild with excellent ductility and stretch flangeability is obtained by specifying and satisfying the composition and components, the metal structure (mean grain size of ferrite, percentage of growth to coarse ferrite grains), the shape of carbide (mean diameter of carbide), and the morphology and distribution of carbide grains.

EXAMPLES

Example 1

Steels having the respective compositions shown in Table 1 were continuously cast to prepare the respective slabs. Thus prepared slabs were heated to 1250° C., and were treated by hot-rolling and annealing under the respective conditions given in Table 2 to obtain the respective hot-rolled steel sheets having a thickness of 3.0 mm.

Samples were collected from each of the hot-rolled steel sheets. With these samples, there were determined the mean grain size of ferrite, the volume percentage of fine ferrite grains, the mean diameter of carbide, the aspect ratio of carbide grains, and the contact ratio of carbide. For evaluating the performance, there were determined the hardness of base material, the total elongation, and the hole expanding ratio. The method and the condition for each measurement are described below.

Mean Grain Size of Ferrite

Determination was given on a light-microscopic structure on a sample cross section in the thickness direction using the cutting method described in JIS G0552. The mean size in the group of 3000 or more of ferrite grains was adopted as the mean grain size.

Volume Percentage of Fine Ferrite Grains

A cross section of sample in the thickness direction was polished and corroded. Then, the microstructure thereof was observed by a light microscope to derive the volume percentage of fine ferrite grains from the area ratio of the grains having 10 μm (20 μm) or smaller size to the grains having larger than 10 μm (20 μm) in size in the entire ferrite grains. The structural observation was given at about ×200 magnification on 10 or more of visual fields, and the average of the mean values was adopted as the volume percentage of fine ferrite grains.

The measurement was conformed to the cutting method described in the "Method for ferrite grain determination test for steel", specified in JIS G-0552.

Mean Grain Size of Carbide

A cross section of sample in the thickness direction was polished and corroded. Then, the microstructure thereof was photographed by a scanning electron microscope to determine the grain size of carbide. The mean size in the group of 500 or more of carbide grains was adopted as the mean size.

Aspect Ratio of Carbide Grains

A cross section of sample in the thickness direction was polished and corroded. Then, the microstructure thereof was photographed by a scanning electron microscope to determine the ratio of the major side length to the minor side length of carbide grain. The number of observed carbide gains was 500 or more, and the percentage of carbide grains having 5 or more of aspect ratio was calculated.

Percentage of Contacts Between Carbide Grains

A cross section of sample was polished and corroded. Then, the microstructure there of was photographed by a scanning electron microscope to calculate the percentage of carbide grains contacting with each other. The number of observed carbide grains was 500 or more.

Hardness of Base Material

A cut face of sample was buffed. In the thickness center portion, five positions were selected to determine the Vickers hardness (Hv) under 500 gf of load, and the average of them was determined as the mean hardness.

Total Elongation: EL

Total elongation was determined by tensile test. A test piece of KS Class 5 was sampled along the 90° direction (C direction) to the rolling direction. The tensile test was given at a test speed of 10 mm/min, thus determined the total elongation (butt-elongation).

Stretch flanging property: hole expanding ratio λ

The stretch flangeability was evaluated by bore expanding test. A sample was punched using a punching tool having a punch diameter $d_o$ of 10 mm and a die diameter of 12 mm (with 20% of clearance), which was then subjected to the bore expanding test. The bore expanding test was done by pushing-up the sample using a cylindrical flat bottom punch (50 mm in diameter and 5 mm in shoulder radius (5 R)) to determine the bore diameter $d_b$ (mm) at the point of generation of penetrated crack at an bore edge. Then, the expanding ratio λ (%) was calculated by the following equation:

$$\lambda(\%)=[(d_b-d_o)/d_o]\times 100.$$

The results obtained from the above measurements are given in Table 3.

In Table 3, Steel sheets Nos. 1 to 15 have the chemical compositions within our range, and are "examples," having the structure within our range in terms of: mean grain size of ferrite, volume percentage of fine ferrite grains (10 μm or smaller size), mean diameter of carbide, percentage of carbide grains having 5 or more of aspect ratio, and contact ratio of carbide. It is shown that the examples have excellent characteristics of low hardness of the base material, 35% or higher total elongation, and 70% or higher hole expanding ratio λ.

Steel sheets Nos. 16 and 18 are comparative examples having the chemical compositions outside our range. Steel sheets Nos. 16 and 17 have the volume percentage of fine ferrite grains (10 μm or smaller size) outside our range, and deteriorates in total elongation and stretch flangeability. Steel sheet No. 18 has the percentage of carbide grains with 5 or more of aspect ratio outside our range, and deteriorates in total elongation and stretch flangeability.

TABLE 1

(% by mass)

| Steel No. | C | Si | Mn | P | S | sol. Al | N | Other | Ar3 | Ac1 | Remark |
|---|---|---|---|---|---|---|---|---|---|---|---|
| A | 0.22 | 0.20 | 0.76 | 0.015 | 0.006 | 0.03 | 0.0043 | tr | 781 | 739 | Example of the invention |
| B | 0.35 | 0.21 | 0.65 | 0.009 | 0.002 | 0.04 | 0.0039 | tr | 750 | 737 | Example of the invention |
| C | 0.33 | 0.02 | 0.38 | 0.023 | 0.018 | 0.02 | 0.0029 | Mo: 0.01 | 777 | 738 | Example of the invention |
| D | 0.34 | 0.19 | 0.71 | 0.011 | 0.001 | 0.03 | 0.0041 | Cr: 0.15 | 746 | 738 | Example of the invention |
| E | 0.45 | 0.81 | 0.22 | 0.012 | 0.003 | 0.04 | 0.0033 | B: 0.002 | 753 | 755 | Example of the invention |
| F | 0.45 | 0.55 | 0.51 | 0.010 | 0.008 | 0.04 | 0.0044 | Ti: 0.02<br>Nb: 0.02 | 730 | 744 | Example of the invention |
| G | 0.54 | 0.22 | 0.70 | 0.008 | 0.002 | 0.02 | 0.0037 | tr | 687 | 730 | Example of the invention |
| H | 0.68 | 0.12 | 0.81 | 0.012 | 0.020 | 0.03 | 0.0041 | tr | 634 | 721 | Example of the invention |
| I | 0.14 | 0.24 | 0.80 | 0.013 | 0.012 | 0.04 | 0.0035 | tr | 803 | 742 | Comparative Example |
| J | 0.75 | 0.21 | 0.75 | 0.008 | 0.006 | 0.04 | 0.0042 | tr | 618 | 722 | Comparative Example |
| K | 0.33 | 1.50 | 1.60 | 0.017 | 0.004 | 0.03 | 0.0045 | tr | 680 | 751 | Comparative Example |

TABLE 2

| Steel sheet No. | Steel No. | Ar3 (° C.) | Ac1 (° C.) | Temperature at inlet of finish rolling (° C.) | Final pass: Reduction of thickness (%) | Final pass: Finishing temperature (° C.) | Primary cooling-start time (sec) | Primary cooling rate (° C./sec) |
|---|---|---|---|---|---|---|---|---|
| 1 | A | 781 | 739 | 1040 | 16 | 870 | 0.7 | 170 |
| 2 | A | 781 | 739 | 1080 | 13 | 840 | 1.7 | 230 |
| 3 | B | 750 | 737 | 1040 | 18 | 820 | 0.7 | 170 |
| 4 | B | 750 | 737 | 1060 | 14 | 790 | 1.6 | 320 |
| 5 | C | 777 | 738 | 1030 | 19 | 850 | 0.8 | 210 |
| 6 | C | 777 | 738 | 1080 | 13 | 780 | 1.5 | 340 |
| 7 | D | 746 | 738 | 1000 | 16 | 810 | 1.0 | 170 |
| 8 | D | 746 | 738 | 1050 | 12 | 770 | 1.6 | 280 |
| 9 | E | 753 | 755 | 1070 | 17 | 860 | 0.5 | 220 |
| 10 | E | 753 | 755 | 1030 | 14 | 790 | 1.1 | 330 |
| 11 | F | 730 | 744 | 1020 | 19 | 830 | 0.4 | 340 |
| 12 | F | 730 | 744 | 1070 | 14 | 780 | 1.4 | 220 |
| 13 | G | 687 | 730 | 1020 | 15 | 760 | 1.2 | 170 |
| 14 | G | 687 | 730 | 1060 | 14 | 740 | 1.6 | 270 |
| 15 | H | 634 | 721 | 1030 | 13 | 720 | 1.4 | 220 |
| 16 | I | 803 | 742 | 1040 | 16 | 890 | 0.5 | 170 |
| 17 | J | 618 | 722 | 1020 | 18 | 710 | 0.7 | 170 |
| 18 | K | 680 | 751 | 1020 | 15 | 880 | 1.2 | 170 |

| Steel sheet No. | Primary cooling-stop temperature (° C.) | Secondary cooling holding temperature (° C.) | Coiling temperature (° C.) | Condition of spheroidizing annealing | Remark |
|---|---|---|---|---|---|
| 1 | 570 | 540 | 500 | 700° C. × 20 hr | Example of the invention |
| 2 | 540 | 530 | 510 | 700° C. × 20 hr | Example of the invention |
| 3 | 570 | 540 | 500 | 720° C. × 40 hr | Example of the invention |
| 4 | 530 | 520 | 480 | 690° C. × 20 hr | Example of the invention |
| 5 | 590 | 580 | 550 | 710° C. × 30 hr | Example of the invention |
| 6 | 550 | 530 | 520 | 680° C. × 20 hr | Example of the invention |
| 7 | 570 | 540 | 500 | 720° C. × 20 hr | Example of the invention |
| 8 | 520 | 500 | 480 | 700° C. × 30 hr | Example of the invention |
| 9 | 530 | 520 | 500 | 720° C. × 30 hr | Example of the invention |
| 10 | 540 | 530 | 510 | 700° C. × 30 hr | Example of the invention |
| 11 | 510 | 520 | 490 | 720° C. × 20 hr | Example of the invention |

TABLE 2-continued

| | | | | | |
|---|---|---|---|---|---|
| 12 | 590 | 550 | 520 | 700° C. × 20 hr | Example of the invention |
| 13 | 560 | 530 | 510 | 720° C. × 40 hr | Example of the invention |
| 14 | 540 | 510 | 500 | 710° C. × 20 hr | Example of the invention |
| 15 | 580 | 570 | 550 | 700° C. × 20 hr | Example of the invention |
| 16 | 570 | 540 | 500 | 680° C. × 30 hr | Comparative Example |
| 17 | 570 | 540 | 500 | 700° C. × 40 hr | Comparative Example |
| 18 | 560 | 530 | 500 | 720° C. × 20 hr | Comparative Example |

TABLE 3

| Steel sheet No. | Steel No. | Mean grain size of ferrite (μm) | Volume percentage of line ferrite grains (10 μm or smaller size) (%) | Mean grain size of carbide | Percentage of carbide grains having 5 or more of aspect ratio (%) | Percentage of contacts between carbide grains (%) | Hardness of base material at thickness center (Hv) | Total elongation (%) | Hole expanding ratio λ (%) | Remark |
|---|---|---|---|---|---|---|---|---|---|---|
| 1 | A | 83 | 13 | 1.8 | 8 | 16 | 98 | 43 | 85 | Example of the invention |
| 2 | A | 79 | 16 | 1.7 | 14 | 19 | 100 | 39 | 77 | Example of the invention |
| 3 | B | 71 | 11 | 1.4 | 11 | 17 | 103 | 41 | 80 | Example of the invention |
| 4 | B | 61 | 18 | 0.8 | 12 | 19 | 108 | 39 | 77 | Example of the invention |
| 5 | C | 67 | 11 | 1.3 | 9 | 14 | 105 | 42 | 83 | Example of the invention |
| 6 | C | 56 | 16 | 0.7 | 14 | 16 | 111 | 40 | 79 | Example of the invention |
| 7 | D | 65 | 14 | 1.2 | 12 | 18 | 108 | 39 | 78 | Example of the invention |
| 8 | D | 63 | 18 | 1.1 | 12 | 18 | 107 | 39 | 77 | Example of the invention |
| 9 | E | 48 | 11 | 1.0 | 13 | 11 | 116 | 38 | 75 | Example of the invention |
| 10 | E | 46 | 14 | 0.9 | 8 | 14 | 120 | 37 | 73 | Example of the invention |
| 11 | F | 45 | 9 | 1.1 | 8 | 12 | 128 | 37 | 73 | Example of the invention |
| 12 | F | 44 | 14 | 0.9 | 13 | 16 | 130 | 36 | 71 | Example of the invention |
| 13 | G | 46 | 16 | 1.4 | 10 | 18 | 120 | 37 | 76 | Example of the invention |
| 14 | G | 44 | 18 | 0.6 | 14 | 19 | 122 | 35 | 70 | Example of the invention |
| 15 | H | 26 | 16 | 1.2 | 10 | 17 | 142 | 35 | 70 | Example of the invention |
| 16 | I | 31 | 65 | 1.0 | 14 | 17 | 135 | 32 | 48 | Comparative Example |
| 17 | J | 3 | 100 | 1.4 | 13 | 19 | 180 | 25 | 23 | Comparative Example |
| 18 | K | 40 | 19 | 1.6 | 17 | 16 | 141 | 30 | 38 | Comparative Example |

Example 2

Steels having the respective compositions shown in Table 4 were continuously cast to prepare the respective slabs. Thus prepared slabs were heated to 1250° C., and were treated by hot rolling and annealing under the respective conditions given in Table 5 to obtain the respective hot-rolled steel sheets having a thickness of 3.0 mm.

Samples were collected from each of the hot-rolled steel sheets. With these samples, there were determined the mean grain size of ferrite, the volume percentage of fine ferrite grains, the mean diameter of carbide, the aspect ratio of carbide grains, and the contact ratio of carbide. For evaluating the performance, there were determined the hardness of base material, the total elongation, and the hole expanding ratio. The method and the condition for each measurement were the same to those of Example 1.

The results obtained from the above measurements are given in Table 6.

In Table 6, Steel sheets Nos. 19 to 29 have the chemical compositions within our range, and are "examples," having the structure within our range in terms of: mean grain size of ferrite, volume percentage of fine ferrite grains (10 μm or smaller size), mean diameter of carbide, percentage of carbide grains having 5 or more of aspect ratio, and contact ratio of carbide. It is shown that the examples have excellent characteristics of low hardness of the base material, 35% or higher total elongation, and 70% or higher expanding ratio λ.

Steel sheet No. 30 is a comparative example having the chemical composition outside our range. Since the volume percentage of fine ferrite grains is outside our range, Steel sheet No. 30 shows inferior total elongation and stretch flangeability.

TABLE 4

(% by mass)

| Steel No. | C | Si | Mn | P | S | sol. Al | N | B | Cr | Other | Ar3 | Ac1 | Remark |
|---|---|---|---|---|---|---|---|---|---|---|---|---|---|
| L | 0.27 | 0.03 | 0.50 | 0.006 | 0.002 | 0.03 | 0.0043 | 0.0019 | 0.23 | tr | 783 | 742 | Example of the invention |
| M | 0.23 | 0.18 | 0.76 | 0.017 | 0.005 | 0.04 | 0.0041 | 0.0029 | 0.20 | tr | 775 | 742 | Example of the invention |
| N | 0.34 | 0.02 | 0.48 | 0.009 | 0.001 | 0.02 | 0.0037 | 0.0022 | 0.21 | tr | 763 | 739 | Example of the invention |
| O | 0.36 | 0.02 | 0.62 | 0.014 | 0.008 | 0.03 | 0.0043 | 0.0025 | 0.12 | Ti: 0.03<br>Nb: 0.02 | 747 | 735 | Example of the invention |
| P | 0.52 | 0.21 | 0.76 | 0.013 | 0.002 | 0.04 | 0.0048 | 0.0025 | 0.22 | Mo: 0.01 | 684 | 733 | Example of the invention |
| Q | 0.67 | 0.52 | 0.72 | 0.010 | 0.011 | 0.03 | 0.0033 | 0.0015 | 0.27 | tr | 641 | 737 | Example of the invention |
| R | 0.14 | 0.20 | 0.78 | 0.016 | 0.009 | 0.03 | 0.0033 | 0.0021 | 0.23 | tr | 801 | 745 | Comparative Example |

TABLE 5

| Steel sheet No. | Steel No. | Ar3 (° C.) | Ac1 (° C.) | Temperature at inlet of finish rolling (° C.) | Final pass Reduction in thickness (%) | Final pass Finishing temperature (° C.) | primary cooling-start time (sec) | Primary cooling rate (° C./sec) |
|---|---|---|---|---|---|---|---|---|
| 19 | L | 783 | 742 | 980 | 18 | 825 | 0.8 | 175 |
| 20 | L | 783 | 742 | 1060 | 13 | 800 | 1.1 | 320 |
| 21 | M | 775 | 742 | 1000 | 17 | 870 | 0.8 | 175 |
| 22 | M | 775 | 742 | 1060 | 14 | 810 | 1.2 | 280 |
| 23 | N | 763 | 739 | 970 | 15 | 805 | 0.8 | 175 |
| 24 | N | 763 | 739 | 1050 | 12 | 780 | 1.6 | 240 |
| 25 | O | 747 | 735 | 1030 | 18 | 800 | 0.9 | 210 |
| 26 | O | 747 | 735 | 1080 | 14 | 760 | 1.2 | 330 |
| 27 | P | 684 | 733 | 960 | 15 | 770 | 1.1 | 175 |
| 28 | P | 684 | 733 | 1050 | 14 | 730 | 1.5 | 320 |
| 29 | Q | 641 | 737 | 1020 | 16 | 720 | 1.3 | 280 |
| 30 | R | 801 | 745 | 1000 | 18 | 880 | 0.8 | 175 |

| Steel sheet No. | Primary cooling-stop temperature (° C.) | Secondary cooling holding temperature (° C.) | Coiling temperature (° C.) | Condition of spheroidizing annealing | Remark |
|---|---|---|---|---|---|
| 19 | 560 | 550 | 510 | 710° C. × 40 hr | Example of the invention |
| 20 | 540 | 530 | 520 | 720° C. × 20 hr | Example of the invention |
| 21 | 560 | 550 | 510 | 690° C. × 20 hr | Example of the invention |
| 22 | 580 | 560 | 550 | 720° C. × 30 hr | Example of the invention |
| 23 | 560 | 550 | 510 | 710° C. × 20 hr | Example of the invention |
| 24 | 500 | 480 | 480 | 700° C. × 30 hr | Example of the invention |
| 25 | 590 | 580 | 560 | 730° C. × 20 hr | Example of the invention |
| 26 | 520 | 500 | 500 | 710° C. × 30 hr | Example of the invention |
| 27 | 580 | 560 | 530 | 710° C. × 40 hr | Example of the invention |
| 28 | 530 | 520 | 510 | 700° C. × 30 hr | Example of the invention |
| 29 | 580 | 550 | 530 | 700° C. × 20 hr | Example o f the invention |
| 30 | 560 | 550 | 510 | 690° C. × 30 hr | Comparative Example |

TABLE 6

| Steel sheet No. | Steel No. | Mean grain size of ferrite (μm) | Volume percentage of fine ferrite grains (10 μm or smaller size) (%) | Mean grain size of carbide (μm) | Percentage of carbide grains having 5 or more of aspect ratio (%) | Percentage of contacts between carbide grains (%) | Hardness of base material at thickness center (Hv) | Total elongation (%) | Hole expanding ratio λ (%) | Remark |
|---|---|---|---|---|---|---|---|---|---|---|
| 19 | L | 76 | 12 | 1.1 | 7 | 10 | 95 | 47 | 88 | Example of the invention |
| 20 | L | 73 | 14 | 1.0 | 13 | 14 | 99 | 44 | 87 | Example of the invention |
| 21 | M | 90 | 7 | 1.7 | 5 | 8 | 92 | 50 | 94 | Example of the invention |
| 22 | M | 96 | 11 | 1.8 | 12 | 13 | 95 | 46 | 91 | Example of the invention |
| 23 | N | 58 | 10 | 1.0 | 7 | 12 | 109 | 44 | 83 | Example of the invention |
| 24 | N | 60 | 14 | 1.1 | 15 | 14 | 109 | 43 | 85 | Example of the invention |
| 25 | O | 55 | 8 | 1.3 | 10 | 8 | 111 | 43 | 85 | Example of the invention |
| 26 | O | 56 | 12 | 1.1 | 14 | 12 | 111 | 42 | 83 | Example of the invention |
| 27 | P | 48 | 13 | 1.8 | 6 | 14 | 110 | 42 | 82 | Example of the invention |
| 28 | P | 44 | 14 | 1.6 | 13 | 15 | 120 | 39 | 77 | Example of the invention |
| 29 | Q | 24 | 13 | 1.2 | 15 | 15 | 147 | 35 | 70 | Example of the invention |
| 30 | R | 67 | 30 | 0.8 | 27 | 7 | 123 | 33 | 48 | Comparative Example |

Example 3

Steels having the respective compositions shown in Table 1 were continuously cast to prepare the respective slabs. Thus prepared slabs were heated to 1250° C., and were treated by hot rolling and annealing under the respective conditions given in Table 7 to obtain the respective hot-rolled steel sheets having a thickness of 3.0 mm.

Samples were collected from each of the hot-rolled steel sheets. With these samples, there were determined the mean grain size of ferrite, the volume percentage of fine ferrite grains, the mean diameter of carbide, the aspect ratio of carbide grains, and the contact ratio of carbide. For evaluating the performance, there were determined the hardness of base material, the total elongation, and the hole expanding ratio. The method and the condition for each measurement were the same to those of Example 1.

The results obtained from the above measurements are given in Table 8.

In Table 8, Steel sheets Nos. 31 to 47 have the chemical compositions within our range, and are "examples," having the structure within our range in terms of: mean grain size of ferrite, volume percentage of fine ferrite grains (20 μm or smaller size), mean diameter of carbide, percentage of carbide grains having 5 or more of aspect ratio, and contact ratio of carbide. It is shown that the examples have excellent characteristics of low hardness of the base material, 35% or higher total elongation, and 70% or higher expanding ratio λ. Since, however, Steel sheet No. 36 exceeds the finishing temperature from (Ar3 90)° C., the mean grain size of ferrite becomes small to some degree.

Steel sheets Nos. 48 to 54 are comparative examples applying the manufacturing conditions outside our range. Comparative Examples of Steel sheets Nos. 48, 49, 50, 53, and 54 have the mean grain size of ferrite outside our range. Also Steel sheets Nos. 48, 49, 50, 52, 53, and 54 have the volume percentage of fine ferrite grains (20 μm or smaller size) outside our range. Steel sheets Nos. 48, 49, 52, 53, and 54 have the percentage of carbide grains having 5 or more of aspect ratio outside our range. Steel sheets Nos. 49, 50, 51, and 52 have the contact ratio of carbide outside our range. As a result, they give high hardness of the base material or significantly deteriorate the total elongation or stretch flangeability.

TABLE 7

| Steel sheet No. | Steel No. | Ar3 (° C.) | Ac1 (° C.) | Temperature at inlet of finish rolling (° C.) | Pass before the final pass: Reduction in thickness (%) | Final pass: Reduction in thickness (%) | Final pass: Rolling temperature (° C.) | Primary cooling-start time (sec) | Primary cooling rate (° C./sec) |
|---|---|---|---|---|---|---|---|---|---|
| 31 | A | 781 | 739 | 1050 | 38 | 15 | 810 | 1.0 | 280 |
| 32 | B | 750 | 737 | 1070 | 35 | 14 | 820 | 0.7 | 170 |
| 33 | B | 750 | 737 | 1020 | 35 | 15 | 820 | 0.7 | 150 |
| 34 | B | 750 | 737 | 1070 | 36 | 14 | 810 | 1.1 | 190 |
| 35 | B | 750 | 737 | 1000 | 36 | 17 | 810 | 0.7 | 200 |
| 36 | B | 750 | 737 | 1070 | 34 | 14 | 920 | 0.7 | 170 |
| 37 | B | 750 | 737 | 1030 | 26 | 19 | 790 | 0.7 | 320 |
| 38 | C | 777 | 738 | 1020 | 28 | 13 | 800 | 0.9 | 290 |
| 39 | D | 746 | 736 | 1060 | 32 | 14 | 810 | 1.0 | 170 |
| 40 | D | 746 | 736 | 1010 | 34 | 16 | 810 | 1.0 | 140 |
| 41 | D | 746 | 736 | 1080 | 32 | 13 | 800 | 0.8 | 190 |
| 42 | D | 746 | 736 | 980 | 30 | 18 | 800 | 0.8 | 200 |
| 43 | D | 746 | 736 | 1040 | 24 | 16 | 780 | 1.1 | 320 |
| 44 | E | 753 | 755 | 1030 | 22 | 17 | 790 | 0.9 | 270 |
| 45 | F | 730 | 744 | 1000 | 28 | 18 | 760 | 0.6 | 290 |
| 46 | G | 687 | 730 | 1040 | 21 | 19 | 750 | 1.2 | 300 |
| 47 | H | 634 | 721 | 1020 | 25 | 13 | 740 | 1.0 | 320 |
| 48 | B | 750 | 737 | 1160 | 34 | 8 | 830 | 0.7 | 170 |
| 49 | B | 750 | 737 | 1070 | 34 | 14 | 760 | 0.7 | 170 |
| 50 | B | 750 | 737 | 1070 | 34 | 14 | 820 | 0.7 | 40 |
| 51 | D | 746 | 736 | 1060 | 33 | 13 | 810 | 2.0 | 170 |
| 52 | D | 746 | 736 | 1060 | 33 | 13 | 810 | 0.7 | 170 |
| 53 | D | 746 | 736 | 1060 | 35 | 15 | 820 | 0.9 | 180 |
| 54 | D | 746 | 736 | 1060 | 35 | 15 | 820 | 0.9 | 180 |

| Steel sheet No. | Primary cooling-stop temperature (° C.) | Secondary cooling holding temperature (° C.) | Coiling temperature (° C.) | Condition of spheroidizing annealing | Remark |
|---|---|---|---|---|---|
| 31 | 580 | 560 | 550 | 700° C. × 30 hr | Example of the invention |
| 32 | 570 | 540 | 500 | 720° C. × 40 hr | Example of the invention |
| 33 | 570 | 540 | 500 | 680° C. × 40 hr | Example of the invention |
| 34 | 520 | 500 | 480 | 720° C. × 20 hr | Example of the invention |
| 35 | 500 | 480 | 450 | 720° C. × 40 hr | Example of the invention |
| 36 | 520 | 500 | 480 | 720° C. × 20 hr | Example of the invention |
| 37 | 550 | 550 | 530 | 700° C. × 30 hr | Example of the invention |
| 38 | 520 | 510 | 500 | 720° C. × 40 hr | Example of the invention |
| 39 | 570 | 540 | 500 | 720° C. × 20 hr | Example of the invention |
| 40 | 560 | 530 | 500 | 690° C. × 40 hr | Example of the invention |
| 41 | 510 | 470 | 440 | 710° C. × 60 hr | Example of the invention |
| 42 | 500 | 470 | 450 | 720° C. × 40 hr | Example of the invention |
| 43 | 540 | 520 | 500 | 700° C. × 20 hr | Example of the invention |
| 44 | 580 | 560 | 550 | 710° C. × 60 hr | Example of the invention |
| 45 | 520 | 500 | 500 | 700° C. × 40 hr | Example of the invention |
| 46 | 530 | 520 | 520 | 720° C. × 40 hr | Example of the invention |
| 47 | 560 | 550 | 540 | 690° C. × 20 hr | Example of the invention |
| 48 | 570 | 540 | 500 | 720° C. × 40 hr | Comparative Example |
| 49 | 570 | 540 | 500 | 680° C. × 40 hr | Comparative Example |
| 50 | 560 | 540 | 510 | 700° C. × 20 hr | Comparative Example |
| 51 | 570 | 540 | 500 | 720° C. × 20 hr | Comparative Example |
| 52 | 640 | 630 | 610 | 700° C. × 40 hr | Comparative Example |
| 53 | 520 | 480 | 450 | 650° C. × 40 hr | Comparative Example |
| 54 | 520 | 480 | 450 | 750° C. × 40 hr | Comparative Example |

TABLE 8

| Steel sheet No. | Steel No. | Mean grain size of ferrite (μm) | Volume percentage of fine ferrite grains (20 μm or smaller size) (%) | Mean grain size of carbide (μm) | Percentage of carbide grains having 5 or more of aspect ratio (%) | Percentage of contacts between carbide grains (%) | Hardness of base material at thickness center (Hv) | Total elongation (%) | Hole expanding ratio λ (%) | Remark |
|---|---|---|---|---|---|---|---|---|---|---|
| 31 | A | 85 | 9 | 1.6 | 10 | 17 | 96 | 44 | 87 | Example of the invention |
| 32 | B | 65 | 12 | 1.3 | 13 | 17 | 113 | 37 | 75 | Example of the invention |
| 33 | B | 47 | 16 | 0.7 | 9 | 16 | 121 | 36 | 77 | Example of the invention |
| 34 | B | 68 | 10 | 1.2 | 12 | 18 | 110 | 39 | 78 | Example of the invention |
| 35 | B | 74 | 8 | 1.5 | 8 | 15 | 97 | 41 | 82 | Example of the invention |
| 36 | B | 28 | 17 | 1.1 | 14 | 14 | 128 | 35 | 71 | Example of the invention |
| 37 | B | 72 | 11 | 1.2 | 11 | 15 | 98 | 41 | 81 | Example of the invention |
| 38 | C | 70 | 13 | 1.3 | 10 | 14 | 97 | 40 | 80 | Example of the invention |
| 39 | D | 62 | 16 | 1.0 | 14 | 18 | 119 | 36 | 76 | Example of the invention |
| 40 | D | 56 | 18 | 0.8 | 9 | 16 | 126 | 35 | 78 | Example of the invention |
| 41 | D | 61 | 13 | 1.2 | 13 | 15 | 120 | 37 | 76 | Example of the invention |
| 42 | D | 67 | 11 | 1.3 | 7 | 13 | 118 | 39 | 80 | Example of the invention |
| 43 | D | 65 | 15 | 1.3 | 13 | 18 | 118 | 37 | 73 | Example of the invention |
| 44 | E | 52 | 9 | 1.2 | 12 | 14 | 113 | 39 | 78 | Example of the invention |
| 45 | F | 54 | 12 | 1.3 | 9 | 12 | 112 | 41 | 80 | Example of the invention |
| 46 | G | 48 | 13 | 1.4 | 10 | 17 | 118 | 38 | 76 | Example of the invention |
| 47 | H | 39 | 15 | 1.6 | 14 | 16 | 135 | 36 | 73 | Example of the invention |
| 48 | B | 5 | 100 | 0.9 | 36 | 15 | 167 | 30 | 35 | Comparative Example |
| 49 | B | 16 | 61 | 1.8 | 23 | 26 | 148 | 21 | 30 | Comparative Example |
| 50 | B | 18 | 74 | 1.6 | 12 | 29 | 158 | 25 | 32 | Comparative Example |
| 51 | D | 50 | 20 | 1.4 | 11 | 34 | 131 | 34 | 27 | Comparative Example |
| 52 | D | 46 | 37 | 1.2 | 19 | 23 | 133 | 28 | 40 | Comparative Example |
| 53 | D | 3 | 100 | 0.6 | 67 | 18 | 174 | 19 | 23 | Comparative Example |
| 54 | D | — | — | — | 81 | 16 | 162 | 31 | 21 | Comparative Example |

Example 4

Steels having the respective compositions shown in Table 4 were continuously cast to prepare the respective slabs. Thus prepared slabs were heated to 1250° C., and were treated by hot rolling and annealing under the respective conditions given in Table 9 to obtain the respective hot-rolled steel sheets having a thickness of 3.0 mm.

Samples were collected from each of the hot-rolled steel sheets. With these samples, there were determined the mean grain size of ferrite, the volume percentage of fine ferrite grains, the mean diameter of carbide, the aspect ratio of carbide grains, and the contact ratio of carbide. For evaluating the performance, there were determined the hardness of base material, the total elongation, and the hole expanding ratio. The method and the condition for each measurement were the same to those of Example 1.

The results obtained from the above measurements are given in Table 10.

In Table 10, Steel sheets Nos. 55 to 68 apply the manufacturing conditions within our range, and are "examples," having the structure within our range in terms of: mean grain size of ferrite, volume percentage of fine ferrite grains (20 μm or smaller size), mean diameter of carbide, percentage of carbide grains having 5 or more of aspect ratio, and contact ratio of carbide. It is shown that the examples have excellent characteristics of low hardness of the base material, 35% or higher total elongation, and 70% or higher expanding ratio λ. Since, however, Steel sheet No. 59 exceeds the finishing temperature from (Ar3+90)° C., the mean grain size of ferrite becomes small to some degree.

Steel sheets Nos. 69 to 75 are comparative examples applying the manufacturing conditions outside our range. Comparative Examples of Steel sheets Nos. 69, 70, 72, 74, and 75 have the mean grain size of ferrite outside our range. Steel sheets Nos. 69, 70, 72, 73, 74, and 75 have the volume percentage of fine ferrite grains (20 gin or smaller size) outside our range. Steel sheets Nos. 69, 72, 73, 74, and 75 have the percentage of carbide grains having 5 or more of aspect ratio outside our range. Steel sheets Nos. 69, 70, and 71 have the contact ratio of carbide outside our range. As a result, they give high hardness of the base material or significantly deteriorate the total elongation or stretch flangeability.

INDUSTRIAL APPLICABILITY

With the use of the high carbon hot-rolled steel sheet, varieties of parts in complex shape such as transmission parts represented by gears are easily worked under a light load. Therefore, our steel sheets are applicable in wide uses centering on tools and automobile parts (gears and transmissions).

TABLE 9

| Steel sheet No. | Steel No. | Ar3 (° C.) | Ac1 (° C.) | Temperature at inlet of finish rolling (° C.) | Pass before the final pass: Reduction in thickness (%) | Final pass: Reduction in thickness (%) | Final pass: Rolling temperature (° C.) | Primary cooling-start time (sec) | Primary cooling rate (° C./sec) |
|---|---|---|---|---|---|---|---|---|---|
| 55 | L | 783 | 742 | 1010 | 35 | 14 | 825 | 0.8 | 175 |
| 56 | L | 783 | 742 | 980 | 35 | 17 | 815 | 0.8 | 170 |

TABLE 9-continued

| | | | | | | | | | |
|---|---|---|---|---|---|---|---|---|---|
| 57 | L | 783 | 742 | 1010 | 37 | 13 | 820 | 1.0 | 180 |
| 58 | L | 783 | 742 | 980 | 34 | 18 | 810 | 1.0 | 210 |
| 59 | L | 783 | 742 | 1010 | 33 | 14 | 915 | 0.6 | 175 |
| 60 | L | 783 | 742 | 1060 | 26 | 15 | 820 | 1.3 | 280 |
| 61 | M | 775 | 742 | 1030 | 22 | 16 | 800 | 1.5 | 330 |
| 62 | N | 763 | 739 | 1010 | 30 | 13 | 805 | 0.8 | 175 |
| 63 | N | 763 | 739 | 970 | 32 | 16 | 810 | 0.8 | 130 |
| 64 | N | 763 | 739 | 1030 | 34 | 12 | 810 | 0.6 | 180 |
| 65 | N | 763 | 739 | 970 | 30 | 19 | 800 | 0.6 | 210 |
| 66 | O | 744 | 739 | 1080 | 24 | 18 | 770 | 1.3 | 320 |
| 67 | P | 684 | 733 | 1060 | 28 | 14 | 720 | 1.2 | 300 |
| 68 | Q | 641 | 737 | 1020 | 32 | 16 | 700 | 1.0 | 260 |
| 69 | L | 783 | 742 | 1020 | 35 | 14 | 780 | 0.8 | 175 |
| 70 | L | 783 | 742 | 1010 | 33 | 14 | 820 | 0.6 | 50 |
| 71 | L | 783 | 742 | 1080 | 28 | 18 | 800 | 2.1 | 220 |
| 72 | L | 783 | 742 | 1130 | 22 | 7 | 830 | 0.8 | 260 |
| 73 | N | 763 | 739 | 1020 | 32 | 13 | 805 | 0.8 | 175 |
| 74 | N | 763 | 739 | 1010 | 34 | 15 | 810 | 0.6 | 180 |
| 75 | N | 763 | 739 | 1010 | 34 | 15 | 810 | 0.6 | 180 |

| Steel sheet No. | Primary cooling-stop temperature (° C.) | Secondary cooling holding temperature (° C.) | Coiling temperature (° C.) | Condition of spheroidizing annealing | Remark |
|---|---|---|---|---|---|
| 55 | 560 | 550 | 510 | 710° C. × 40 hr | Example of the invention |
| 56 | 560 | 550 | 510 | 680° C. × 40 hr | Example of the invention |
| 57 | 510 | 500 | 470 | 720° C. × 40 hr | Example of the invention |
| 58 | 530 | 520 | 490 | 700° C. × 20 hr | Example of the invention |
| 59 | 510 | 500 | 470 | 720° C. × 40 hr | Example of the invention |
| 60 | 580 | 560 | 530 | 700° C. × 40 hr | Example of the invention |
| 61 | 530 | 520 | 500 | 720° C. × 60 hr | Example of the invention |
| 62 | 560 | 550 | 510 | 710° C. × 20 hr | Example of the invention |
| 63 | 530 | 510 | 490 | 700° C. × 40 hr | Example of the invention |
| 64 | 510 | 480 | 460 | 680° C. × 60 hr | Example of the invention |
| 65 | 510 | 470 | 440 | 720° C. × 40 hr | Example of the invention |
| 66 | 550 | 540 | 520 | 700° C. × 30 hr | Example of the invention |
| 67 | 570 | 560 | 540 | 710° C. × 40 hr | Example of the invention |
| 68 | 520 | 500 | 500 | 690° C. × 30 hr | Example of the invention |
| 69 | 560 | 550 | 510 | 680° C. × 40 hr | Comparative Example |
| 70 | 530 | 520 | 490 | 700° C.× 20 hr | Comparative Example |
| 71 | 580 | 560 | 550 | 720° C. × 40 hr | Comparative Example |
| 72 | 560 | 550 | 510 | 710° C. × 40 hr | Comparative Example |
| 73 | 630 | 620 | 600 | 700° C. × 40 hr | Comparative Example |
| 74 | 510 | 470 | 460 | 650° C. × 40 hr | Comparative Example |
| 75 | 510 | 470 | 430 | 750° C. × 40 hr | Comparative Example |

TABLE 10

| Steel sheet No. | Steel No. | Mean grain size of ferrite (μm) | Volume percentage of fine ferrite grains (20 μm or smaller size) (%) | Mean grain size of carbide (μm) | Percentage of carbide grains having 5 or more of aspect ratio (%) | Percentage of contacts between carbide grains (%) | Hardness of base material at thickness center (Hv) | Total elongation (%) | Hole expanding ratio λ (%) | Remark |
|---|---|---|---|---|---|---|---|---|---|---|
| 55 | L | 71 | 17 | 1.1 | 8 | 10 | 101 | 45 | 85 | Example of the invention |
| 56 | L | 59 | 15 | 0.8 | 5 | 9 | 107 | 43 | 80 | Example of the invention |
| 57 | L | 75 | 14 | 1.3 | 7 | 11 | 97 | 44 | 85 | Example of the invention |
| 58 | L | 86 | 9 | 1.1 | 4 | 8 | 93 | 48 | 90 | Example of the invention |
| 59 | L | 33 | 18 | 1.1 | 8 | 12 | 119 | 40 | 81 | Example of the invention |
| 60 | L | 68 | 17 | 1.0 | 14 | 15 | 103 | 43 | 84 | Example of the invention |
| 61 | M | 90 | 7 | 1.2 | 10 | 16 | 90 | 50 | 100 | Example of the invention |
| 62 | N | 53 | 13 | 0.9 | 8 | 12 | 117 | 43 | 82 | Example of the invention |
| 63 | N | 60 | 11 | 0.8 | 6 | 10 | 110 | 44 | 84 | Example of the invention |
| 64 | N | 65 | 9 | 0.9 | 7 | 8 | 108 | 42 | 78 | Example of the invention |
| 65 | N | 71 | 8 | 1.4 | 5 | 7 | 105 | 45 | 86 | Example of the invention |
| 66 | O | 70 | 8 | 1.3 | 15 | 15 | 106 | 41 | 78 | Example of the invention |
| 67 | P | 52 | 11 | 1.8 | 14 | 14 | 110 | 40 | 79 | Example of the invention |
| 68 | Q | 38 | 17 | 1.8 | 11 | 12 | 139 | 37 | 72 | Example of the invention |
| 69 | L | 18 | 58 | 1.9 | 21 | 23 | 150 | 24 | 32 | Comparative Example |
| 70 | L | 17 | 71 | 1.7 | 13 | 26 | 155 | 26 | 36 | Comparative Example |
| 71 | L | 38 | 18 | 1.5 | 10 | 38 | 116 | 31 | 39 | Comparative Example |
| 72 | L | 7 | 100 | 1.0 | 32 | 14 | 165 | 28 | 38 | Comparative Example |

TABLE 10-continued

| Steel sheet No. | Steel No. | Mean grain size of ferrite (μm) | Volume percentage of fine ferrite grains (20 μm or smaller size) (%) | Mean grain size of carbide (μm) | Percentage of carbide grains having 5 or more of aspect ratio (%) | Percentage of contacts between carbide grains (%) | Hardness of base material at thickness center (Hv) | Total elongation (%) | Hole expanding ratio λ (%) | Remark |
|---|---|---|---|---|---|---|---|---|---|---|
| 73 | N | 36 | 65 | 1.4 | 17 | 18 | 148 | 27 | 41 | Comparative Example |
| 74 | N | 2 | 100 | 0.6 | 72 | 13 | 181 | 18 | 25 | Comparative Example |
| 75 | N | — | — | — | 84 | 9 | 167 | 28 | 28 | Comparative Example |

The invention claimed is:

1. A high carbon hot rolled steel sheet comprising 0.2 to 0.7% C, 0.01 to 1.0% Si, 0.1 to 1.0% Mn, 0.03% or less P, 0.035% or less S, 0.08% or less Al, 0.01% or less N; by mass, and balance of iron and inevitable impurities; wherein mean grain size of ferrite is 20 μm or larger; the volume percentage of ferrite grains having 10 μm or smaller size is 20% or less; mean diameter of carbide is in a range from 0.10 μm to smaller than 2.0 μm; the percentage of carbide grains having 5 or more of aspect ratio is 15% or less; and the contact ratio of carbide is 20% or less.

2. The high carbon hot-rolled steel sheet according to claim 1, further comprising one or both of 0.0010 to 0.0050% B and 0.005 to 0.30% Cr, by mass.

3. The high carbon hot-rolled steel sheet according to claim 1, further comprising 0.0010 to 0.0050% B and 0.05 to 0.30% Cr, by mass.

4. The high carbon hot-rolled steel sheet according to claim 1, further comprising one or more of 0.005 to 0.5% Mo, 0.005 to 0.05% Ti, and 0.005 to 0.1% Nb, by mass.

5. The high carbon hot-rolled steel sheet according to claim 2, further comprising one or more of 0.005 to 0.5% Mo, 0.005 to 0.05% Ti, and 0.005 to 0.1% Nb, by mass.

6. The high carbon hot-rolled steel sheet according to claim 3, further comprising one or more of 0.005 to 0.5% Mo, 0.005 to 0.05% Ti, and 0.005 to 0.1% Nb, by mass.

7. A high carbon hot rolled steel sheet comprising 0.2 to 0.7% C, 0.01 to 1.0% Si, 0.1 to 1.0% Mn, 0.03% or less P, 0.035% or less S, 0.08% or less Al, 0.01% or less N, by mass, and balance of iron and inevitable impurities; wherein the mean grain size of ferrite is larger than 35 μm; the volume percentage of ferrite grains having 20 μm or smaller size is 20% or less; the mean diameter of carbide is in a range from 0.10 μm to smaller than 2.0 μm; the percentage of carbide grains having 5 or more of aspect ratio is 15% or less; and the contact ratio of carbide is 20% or less.

8. The high carbon hot-rolled steel sheet according to claim 7, further comprising one or both of 0.0010 to 0.0050% B and 0.005 to 0.30% Cr, by mass.

9. The high carbon hot-rolled steel sheet according to claim 7, further comprising 0.0010 to 0.0050% B and 0.05 to 0.30% Cr, by mass.

10. The high carbon hot-rolled steel sheet according to claim 7, further comprising one or more of 0.005 to 0.5% Mo, 0.005 to 0.05% Ti, and 0.005 to 0.1% Nb, by mass.

11. A method for manufacturing high carbon hot-rolled steel sheet comprising the steps of:

rough-rolling a steel having a composition comprising 0.2 to 0.7% C, 0.01 to 1.0% Si, 0.1 to 1.0% Mn, 0.03% or less P, 0.035% or less S, 0.08% or less A1, 0.01% or less N, by mass, and balance of iron and inevitable impurities;

finish-rolling the rough-rolled steel sheet at a temperature of 1100° C. or below at an inlet of finish rolling, a reduction in thickness of 12% or more at a final pass, and a finishing temperature of (Ar3−10)° C. or above;

primary-cooling the finish-rolled steel sheet to a cooling-stop temperature of 600° C. or below within 1.8 seconds after the finish rolling at a cooling rate of higher than 120° C./sec;

secondary-cooling the primary-cooled steel sheet to hold the steel sheet at a temperature of 600° C. or below;

coiling the secondary-cooled steel sheet at a temperature of 580° C. or below;

pickling the coiled steel sheet; and spheroidizing-annealing the pickled steel sheet by box annealing at a temperature in a range from 680° C. to Ac1 transformation point such that mean grain size of ferrite is 20 μm or larger; the volume percentage of ferrite grains having 10 μm or smaller size is 20% or less; mean diameter of carbide is in a range from 0.10 μm to smaller than 2.0 μm; the percentage of carbide grains having 5 or more of aspect ratio is 15% or less; and the contact ratio of carbide is 20% or less.

12. A method for manufacturing high carbon hot-rolled steel sheet comprising the steps of:

rough-rolling a steel having a composition comprising 0.2 to 0.7% C, 0.01 to 1.0% Si, 0.1 to 1.0% Mn, 0.03% or less P, 0.035% or less S, 0.08% or less Al , 0.01% or less N, by mass, and balance of iron and inevitable impurities;

finish-rolling the rough-rolled steel sheet at a temperature of 1100° C. or below at an inlet of finish rolling, at a reduction in thickness of 12% or more at each of two final passes, and in a temperature range from (Ar3−10)° C. to (Ar3+90)° C.;

primary-cooling the finish-rolled steel sheet to a cooling-stop temperature of 600° C. or below within 1.8 seconds after the finish rolling at a cooling rate of higher than 120° C./sec;

secondary-cooling the primary-cooled steel sheet to hold the steel sheet at a temperature of 600° C. or below;

coiling the secondary-cooled steel sheet at a temperature of 580° C. or below;

pickling the coiled steel sheet; and spheroidizing-annealing the pickled steel sheet by box annealing at a temperature in a range from 680° C. to Ac1 transformation point, with a soaking time of 20 hours or more such that mean grain size of ferrite is larger than 35 μm; the volume percentage of ferrite grains having 20 μm or smaller size is 20% or less; the mean diameter of carbide is in a range from 0.10 μm to smaller than 2.0 μm; the percentage of carbide grains having 5 or more of aspect ratio is 15% or less; and the contact ratio of carbide is 20% or less.

13. The method according to claim 12, wherein the finish rolling is conducted at a temperature of 1050° C. or below at the inlet of finish rolling, and the reduction in thickness at each of the final two passes of 15% or more.

* * * * *

UNITED STATES PATENT AND TRADEMARK OFFICE

CERTIFICATE OF CORRECTION

PATENT NO. : 8,048,237 B2
APPLICATION NO. : 12/294639
DATED : November 1, 2011
INVENTOR(S) : Kimura et al.

It is certified that error appears in the above-identified patent and that said Letters Patent is hereby corrected as shown below:

In Column 1

At line 59, please change “MN” to --A1N--.

In Column 3

At line 2, please change “Ad” to --Ac1--.

In Column 7

At line 8, please change “(0.01%” to --0.01%--.

Signed and Sealed this
Twenty-seventh Day of March, 2012

David J. Kappos

David J. Kappos
*Director of the United States Patent and Trademark Office*